United States Patent [19]

Korhonen et al.

[11] Patent Number: 4,757,654

[45] Date of Patent: Jul. 19, 1988

[54] BLISTER PRESSURE RELIEF VALVE

[75] Inventors: Charles J. Korhonen, Etna; Frederick C. Gernhard, Lyme, both of N.H.

[73] Assignee: The United States of America as represented by the Secretary of the Army, Washington, D.C.

[21] Appl. No.: 14,574

[22] Filed: Feb. 13, 1987

[51] Int. Cl.[4] ..... E04B 7/00

[52] U.S. Cl. ..... 52/199; 52/303; 137/197

[58] Field of Search ..... 52/302, 303, 199; 137/197, 199

[56] References Cited

U.S. PATENT DOCUMENTS

| | | | |
|---|---|---|---|
| 2,868,219 | 1/1959 | Lucks | 137/197 |
| 3,326,230 | 6/1967 | Frank | 137/199 |
| 3,619,961 | 11/1971 | Sterrett et al. . | |
| 3,765,895 | 9/1973 | Bellamy . | |
| 3,984,947 | 10/1976 | Patry . | |
| 4,223,486 | 9/1980 | Kelly . | |
| 4,484,424 | 11/1984 | Logsdon . | |

*Primary Examiner*—Alan Cohan

*Attorney, Agent, or Firm*—Charles W. Calkins

[57] ABSTRACT

A valve is disclosed for venting and relieving pressure within a blister in a built-up, multiple layer roof structure, which includes a hollow shaft having one open end adapted to be inserted into the blister and the other end covered by an air permeable, water impermeable membrane protected by a housing. The exterior of the shaft is threaded to permit penetration into the blister and holding of the valve. Air is vented through the membrane and out a passage provided in the housing.

26 Claims, 2 Drawing Sheets

BLISTER PRESSURE RELIEF VALVE

FIELD OF THE INVENTION

This invention relates generally to valves, and more particularly to a valve for venting trapped gases and relieving pressure from a blister in a roof structure.

THE PRIOR ART

Roofs are customarily protected by placing on their supporting surface or substrate one or more sheets or layers of material which provide a continuous waterproof protective top layer or membrane. Built-up roofs comprise multiple layers of material, such as roofing felt, impregnated and/or coated with an asphaltic or bituminous material to bond the layers together into a waterproof membrane and impart moisture resistance. Waterproofness may also be achieved with multiple coatings of polymeric material to form the membrane. One or more insulation layers may be provided between the substrate and the waterproof membrane.

Blisters in such roof structures are caused by the expansion of pockets of gases and/or vapor trapped either between the plies of the roof membrane or between the membrane and the impermeable substrate. Certain gases are produced within the layers of the membrane by the materials used. Air pockets may result from defects such as skips or voids in the bitumen, entrapped debris, bitumen bubbling and curled interply felts due to improper design and/or poor workmanship. Since a perfect, void-free, built-up membrane is difficult to fabricate, even under the best conditions, some blistering is likely. Vaporization of trapped or accumulated moisture also may form blisters.

Blisters significantly increase the likelihood of roof leaks. If they remain small and intact, the performance of a built-up membrane is not adversely affected. However, blisters generally increase in size with time, which increases the vulnerability of the roof membrane to weathering and to punctures. Larger blisters are susceptible to damage, such as from foot traffic and increased weathering, and once a blister is ruptured a roof leak will likely develop unless immediate repairs are made. Even if blisters do not leak, they can adversely affect a roof's performance in other ways. Since the blisters usually occur between the plies of a built-up membrane, they are apt to weaken the membrane, causing it to be more susceptible to splits and separation. Blisters can also contribute to the general deterioration of a roof by affecting drainage patterns, creating water puddles or ponds.

Recent studies involving pressure measurements and visual examinations were conducted by the Applicants to determine the cause of roof blisters, and to develop new techniques for dealing with them. The pressure measurements indicate that the internal blister pressures vary from positive during the heat of the day, to negative during the cool of the night, and explain why blisters grow. Air is drawn into the blister at night and, when exposed to heat, rapidly expands before it has a chance to escape, causing increase of pressure which results in growth of the blister. The pressure measurements also indicate that water vapor is not needed to pressurize a blister. Visual examination of blisters suggests that most are built into a roof, as a result of poor design and/or poor workmanship.

Current practice in roof maintenance is to leave a blister alone if it is intact and its surface is not severely weathered. Among the few current options available for dealing with blisters is to cut each blister open and patch it with roofing cement. Since it is slow and tedious, this approach is generally not used until a blister breaks. Great care must be taken not to entrap air pockets within the patch, which would create a new crop of blisters. A roof with numerous blisters is generally considered non-repairable and is replaced.

Roof breather vents have been promoted as a means of eliminating blisters. However, since most blisters occur between the membrane plies, or between the membrane and the impermeable insulation facing below it, such vents do not affect these blisters because the vents communicate only with the insulation layer. Roof breather vents do not prevent membrane blistering. Examples of roof breather vents are disclosed in U.S. Pat. Nos. 3,984,947, issued to Patry, 4,223,486, issued to Kelly, and 4,484,424, issued to Logsdon. The vents of Patry and Logsdon are designed to vent pressure and moisture from the insulated space of a roof structure, or the space between the substrate and the overlying insulation. Kelly provides a vent for equalizing pressure between the top of the roof and the space between the roof decking and the insulation layer.

Measurements made by the Applicants indicate that no measurable pressure develops within the insulated space of a conventional built-up roof structure. Almost all blisters occur within the built-up roof membrane. Roof vents, such as those disclosed by Patry and Logsdon, which open into the insulation, do not communicate with these membrane blisters and, therefore, do not relieve the pressure and vapor developed therein.

Instead of using mechanical roof vents, Bellamy, U.S. Pat. No. 3,756,895, uses a membrane of a microporous material which is vapor permeable and liquid impermeable to vent the insulated space directly above the roof decking. This technique, similarly, does not address the problem of blisters formed within the membrane.

SUMMARY OF THE INVENTION

Accordingly, among the objects of the present invention are to provide a new and improved valve for venting pressure and vapor from a roof blister; a valve of the foregoing type designed to vent blisters developed within the layers of a multiple-ply, built-up roof membrane; a valve of the foregoing type which is small in size, can be readily installed by insertion directly into the blister, and is rugged to withstand foot traffic and, once installed, halts blister growth.

These and other objects of the invention are attained in a pressure relief valve of small size having a hollow shaft with one end covered by an air permeable and water impermeable membrane which in turn is protected by an environmentally-durable housing. The lower end of the shaft provides fluid communication with the interior of the blister, and the upper end of the shaft communicates with a chamber through the membrane, with the chamber being vented via a channel extending to the outside of the valve housing. Screw-like threads on the exterior surface of the shaft permits insertion of the valve by threading the shaft directly into the blister. Alternatively, the lower end of the shaft may be provided with a sharpened point for piercing the blister.

A better understanding and appreciation of the foregoing description, as well as other objects, features and advantages of the invention, may be obtained from the following description of presently-preferred embodiments, considered in conjunction with the accompanying drawings.

DETAILED DESCRIPTION OF THE PREFERRED EMBODIMENTS

Figure 1:
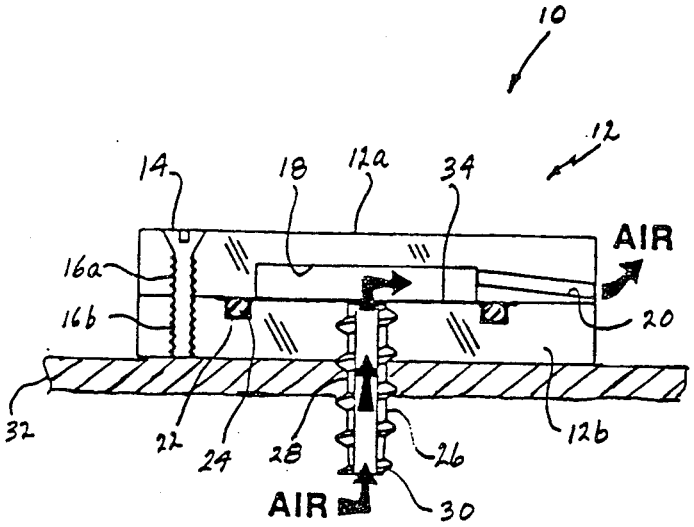
FIG. 1 is an elevational, sectional view of the valve of the present invention.

Referring now to the drawings, wherein similar reference numerals designate the same or similar elements throughout the several views, FIG. 1 shows a sectional view of a valve 10 according to the present invention having a housing 12 comprised of upper and lower sections 12*a* and 12*b* joined together by fasteners 14 (one shown) extending through aligned bores 16*a* and 16*b* provided in the housing sections. While a threaded fastener is shown in FIG. 1, any other suitable fastener may be used.

Housing section 12*a* has a central recessed region forming a chamber 18 from which a passage 20 leads to the exterior of the housing. Passage 20 is angled downwardly, to preclude entry of rain or debris. The upper surface of housing section 12*b* has an annular groove 22 positioned such that when the housing sections are assembled as shown in FIG. 1, the groove is disposed radially outwardly of chamber 18. A seal 24 of resilient material, such as an O-ring, is received within groove 22. A hollow shaft 26 has an upper portion fixedly disposed in a central bore 28 provided in housing section 12*b*, with a lower portion of the shaft extending below the lower surface of housing section 12*b*. Screw-type threads 30 are provided on the exterior surface of shaft 26 such that when valve 10 is rotated, the threads bite into the wall of the blister, represented schematically at 32, advancing the shaft into the interior of the blister. Both ends of shaft 26 are open, with the lower end extending into the blister and the upper end covered by a membrane 34, the edges of which are received in annular groove 22 and secured therein by O-ring 24. Membrane 34 also serves to cover chamber 18 in housing section 12*a*, and is fabricated of a material which is permeable to air and other gases and impermeable to water and other liquids. A number of suitable materials are available commercially which meets these requirements, such as microporous material of metallic, ceramic or polymeric composition.

Valve 10 has no moving parts, is small in size and provides minimum obstruction to foot traffic on the roof, and may be made from any suitable, environmentally tough material, such as a polymer material. As an example, valve 10 may have a diameter of approximately 1.5 inches (3.8 mm) and a thickness of approximately 0.5 inches (1.27 mm), and shaft 26 may extend approximately ⅜ inches (0.95 mm) beyond the lower surface of housing 12. In use, the roof surface around the blister is prepared by removing all gravel and loose dirt, priming the surface and adding a bead of roof cement to the underside of valve 10 to create a seal with the roof when the valve is installed. Installation is achieved by screwing shaft 26 into a pilot hole (not shown) created in the blister wall 32 with a suitable tool, such as an awl. During installation, if shaft 26 becomes plugged, housing section 12*a* may be removed by loosening fasteners 14 and the shaft cleared with a wire-type probe or similar small-diameter tool, having a size less than 1/16th inches in diameter (0.16 mm). Membrane 34, disposed between housing sections 12*a*, and 12*b* vents through the passage 20 any pressure built up within the blister. Although ponded water could conceivably enter upper section 12*b* through the exit port of passage 20, membrane 34, being impermeable to water, prevents water from entering the blister.

Valve 10 is of low profile and of sufficiently large diameter, as indicated by the representative dimensions noted above, to make it highly resistant to damage from foot traffic on the roof. The short length of shaft 26 minimizes any chances of valve 10 backing out of the blister should the raised portion of the collapsing blister come in contact with the membrane below during contraction. Once installed, valve 10 will prevent the blister from increasing in size, and will help avoid the need for expensive remedial repairs to broken blisters, which in turn should significantly reduce the cost of maintaining roofs that have blisters, as well as prolonging the useful life of the roof. The valve requires no maintenance.

Figure 2:
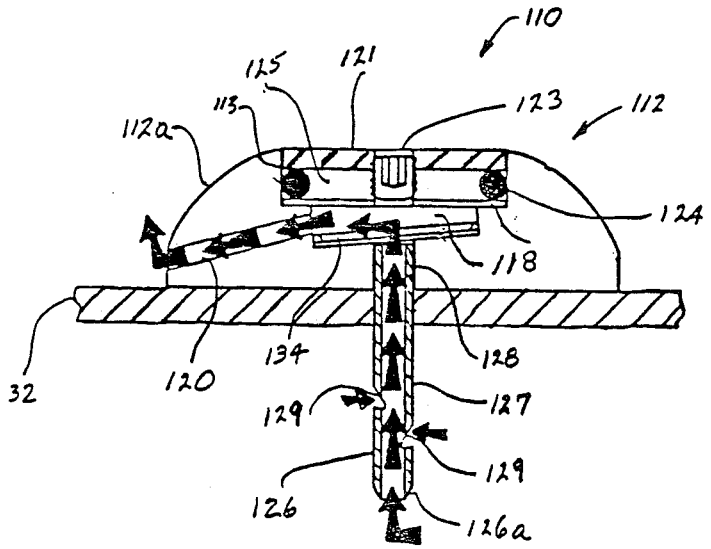
FIG. 2 shows an alternate embodiment of the valve.

An alternative embodiment of the pressure venting valve of the present invention is shown in FIG. 2, with parts identified with 100-series reference numerals. Valve 110 comprises a one-piece housing 112 having a smooth contoured outer surface 112*a*, centrally bored as at 113 to provide a chamber 118, with a passage 120 extending downwardly at an angle from the chamber to the exterior of the valve. Bore 113 is closed by a removable cover or lid 121 secured by a fastener 123, and having a seal, such as an O-ring, disposed beneath the lid to seal chamber 118.

A hollow shaft 126 is secured within a bore 128 in housing 112, with the exterior surface 127 of the shaft being smooth and having a number of holes 129 penetrate the thickness of the shaft along the length thereof. As shown, the lower end 126*a* of shaft 126 is sharpened to permit installation of vent 110 by directly forcing the sharpened end 126*a* into the blister 32 without first creating a hole with a separate tool. The upper end of shaft 126 communicates with chamber 118 through a membrane 134 which is structurally and functionally identical to the air-permeable, moisture-impermeable membrane 34 in the embodiment of FIG. 1. Once installed, vent 110 functions in the same manner as vent 10 described above. Removal of lid 121 permits clearance of any material which may become lodged in shaft 126.

Alternative designs may be used which would preclude the need for fasteners to secure the two sections of valve 10. As an example, the valve can be designed of plastic, with the two sections snapping together with resilient elements. The threaded shaft 26 may also be formed together with the lower housing section 12*b* as an integral unit. Various other modifications may also be made.

Although preferred embodiments of the present invention have been described, and modifications considered, it is to be understood that further modifications and variations may be made by those skilled in the art without departing from the spirit of the invention, and such modifications and variations are considered to be within the purview and scope of the invention as defined by the appended claims.

What is claimed is:

1. An apparatus comprising:

a roof structure having a top and a bottom layer and at least one intermediate layer between said top and bottom layers;

a housing having an interior chamber in fluid communication with the exterior of said housing via a fluid passage;

an open-ended hollow shaft having a first portion disposed in said housing in fluid communication with said chamber, and a second portion extending from said housing communicating with said intermediate layer of said roof structure; and a membrane disposed over the open end of said first portion of the shaft to separate said shaft end from said chamber, said membrane being gas permeable and liquid impermeable to permit passage of gases across said membrane and preclude passage of liquid across said membrane, thereby allowing gases to be vented from said intermediate layer of said roof structure without allowing liquid to penetrate into said intermediate layer of said roof structure.

2. An apparatus as defined in claim 1, wherein said membrane comprises a microporous material.

3. An apparatus as defined in claim 2, wherein the exterior surface of said second portion of said shaft is provided with screw threads.

4. An apparatus as defined in claim 3, wherein said housing is comprised of separable sections assembled with removable fasteners and said fluid passage is inclined downwardly relative to the upper surface of said housing to preclude entry rain and debris into said chamber.

5. An apparatus as defined in claim 3, wherein said housing is comprised of single section and said fluid passage is inclined downwardly relative to the upper surface of said housing to preclude entry rain and debris into said chamber.

6. An apparatus as defined in claim 5, wherein said housing further comprises a closure member which is removable to provide access to said chamber.

7. An apparatus as defined in claim 2, wherein said second portion of said shaft has at least one opening penetrating the longitudinal thickness of the shaft.

8. An apparatus as defined in claim 7, wherein the lower end of the second portion of said shaft terminates a pointed surface to permit penetration of the blister.

9. An apparatus as defined in claim 8, wherein said housing is comprised of separable sections assembled with removable fasteners and said fluid passage is inclined downwardly relative to the upper surface of said housing to preclude entry rain and debris into said chamber.

10. An apparatus as defined in claim 8, wherein said housing is comprised of single section having a closure member which is removable to provide access to said chamber, and said fluid passage is inclined downwardly relative to the upper surface of said housing to preclude entry rain and debris into said chamber.

11. A method of venting a blister in a roof structure by installing directly in the wall of the blister a valve which will permit flow of gases from the blister and prevent entry of liquid into the blister, said valve having a housing with an interior chamber in fluid communication with the exterior of the housing via a fluid passage, an open-ended hollow shaft having a first portion disposed in said housing in fluid communication with said chamber, and a second portion extending from said housing and adapted for insertion into the blister, and a membrane of microporous material disposed over the open end of said first portion of the shaft to separate said shaft end from said chamber, the membrane being gas permeable and liquid impermeable to permit passage of gases across said membrane and preclude passage of liquid across the membrane.

12. A method as defined in claim 11, wherein the exterior surface of said second portion of said shaft is provided with screw threads, and said valve is installed by rotating the valve to penetrate the blister with said threads.

13. A method as defined in claim 12, wherein said housing has a removable section to provide access to said chamber, membrane and said first shaft portion.

14. A method as defined in claim 11, wherein the lower end of the second portion of said shaft terminates in a pointed surface, and said valve is installed by piercing the blister, said second portion of shaft having at least on opening penetrating the longitudinal thickness of the shaft to provide an additional flow path from the blister to said chamber.

15. A method as defined in claim 14, wherein said housing has a removable portion to provide access to said chamber, membrane and said first shaft portion.

16. A method for venting a roof structure comprising:

inserting an apparatus in a roof structure having a top and a bottom layer and at least one intermediate layer between said top and bottom layer, said apparatus comprising a housing having an interior chamber in fluid communication with the exterior of said housing via a fluid passage, an open-ended hollow shaft having a first portion disposed in said housing in fluid communication with said chamber and a second portion, having an interior an exterior surface extending from said housing communicating with said intermediate layer of said roof structure, and a membrane disposed over the open end of said first portion of the shaft to separate said shaft end from said chamber, said membrane being gas permeable and liquid impermeable to permit passage of gases across said membrane and preclude passage of liquid across said membrane, thereby allowing gases to be vented from said intermediate layer of said roof structure without allowing liquid to penetrate into said intermediate layer of said roof structure.

17. The method of claim 16 wherein said membrane comprises a microporous material.

18. The method of claim 17 wherein said second portion of said shaft has at least one opening penetrating the longitudinal thickness of said shaft.

19. The method of claim 16 wherein said exterior surface of said second portion of said shaft is provided with screw threads, and said apparatus is inserted into said roof structure by rotating said apparatus to penetrate said roof structure with said threads.

20. The method of claim 19 wherein said housing has a removable section to provide access to said chamber, said membrane and said first shaft portion.

21. The method of claim 19 wherein said housing comprises separable sections assembled with removable fasteners and said fluid passage is inclined downwardly relative to the upper surface of said housing to preclude entry of rain and debris.

22. The method of claim 19 wherein said housing comprises a single section and said fluid passage is inclined downwardly relative to said upper surface of said housing to preclude entry of rain and debris into said chamber.

23. The method of claim 16 wherein a lower end of said second portion of said shaft terminates in a pointed surface, and said valve is inserted into said roof structure by piercing said roof structure, said second portion of said shaft having at least one opening penetrating the longitudinal thickness of said shaft to provide an additional flow path from said roof structure to said chamber.

24. The method of claim 23 wherein said housing has a removable section to provide access to said chamber, said membrane, and said first shaft portion.

25. The method of claim 23 wherein said housing comprises separable sections assembled with removable fasteners and said fluid passage is inclined downwardly relative to the upper surface of said housing to preclude entry of rain and debris.

26. The method of claim 23 wherein said housing comprises a single section having a closure member which is removable to provide access to said chamber, and said fluid passage is inclined downwardly relative to said upper surface of said housing to preclude entry of rain and debris into said chamber.

* * * * *